US007722282B2

(12) United States Patent
Meidan

(10) Patent No.: US 7,722,282 B2
(45) Date of Patent: May 25, 2010

(54) CRASH BARRIERS FOR ROADS

(75) Inventor: Yoram Meidan, Moshav Gan Shomron (IL)

(73) Assignee: Alexander Sagy, Omer (IL)

( * ) Notice: Subject to any disclaimer, the term of this patent is extended or adjusted under 35 U.S.C. 154(b) by 0 days.

(21) Appl. No.: 10/507,496

(22) PCT Filed: Mar. 12, 2003

(86) PCT No.: PCT/IL03/00202

§ 371 (c)(1),
(2), (4) Date: Aug. 18, 2005

(87) PCT Pub. No.: WO03/076724

PCT Pub. Date: Sep. 18, 2003

(65) Prior Publication Data

US 2006/0013650 A1 Jan. 19, 2006

(30) Foreign Application Priority Data

Mar. 14, 2002 (IL) ..... 148689

(51) Int. Cl.
*E01F 15/00* (2006.01)

(52) U.S. Cl. ..... 404/6

(58) Field of Classification Search ..... 404/6, 404/10; 256/1, 13.1
See application file for complete search history.

(56) References Cited

U.S. PATENT DOCUMENTS

| | | | | | |
|---|---|---|---|---|---|
| 3,711,662 | A | * | 1/1973 | Kuhn | 200/48 A |
| 4,376,594 | A | | 3/1983 | Prosenz | |
| 4,681,302 | A | * | 7/1987 | Thompson | 256/13.1 |
| 4,815,889 | A | * | 3/1989 | Duckett | 404/6 |
| 4,869,018 | A | * | 9/1989 | Scales et al. | 47/33 |
| 5,022,781 | A | * | 6/1991 | Smith | 404/6 |
| 5,149,224 | A | * | 9/1992 | Smith | 404/6 |
| 5,286,136 | A | * | 2/1994 | Mandish et al. | 404/6 |

(Continued)

FOREIGN PATENT DOCUMENTS

EP 0 596 405 A 5/1994

(Continued)

OTHER PUBLICATIONS

Patent Abstract of Japan, vol. 1998, No. 11; Sep. 30, 1998 & JP 10 168843 A.

*Primary Examiner*—Gary S Hartmann
(74) *Attorney, Agent, or Firm*—Lowe Hauptman Ham & Berner LLP

(57) ABSTRACT

A crash barrier assembly has a plurality of prismatic, solid structural elements, at least one of the elements having a shoulder forming a horizontal surface on at least one of its sides, and another element having substantially matching surfaces on at least one of its sides so as to facilitate juxtaposing of the elements. A coupler resiliently interconnects the elements to each other in a manner facilitating relative controlled movement along the horizontal surface of the one element with respect to the other about the coupler. A method for erecting a crash barrier is also provided.

9 Claims, 4 Drawing Sheets

U.S. PATENT DOCUMENTS

| | | | | | |
|---|---|---|---|---|---|
| 5,605,413 | A * | 2/1997 | Brown | 404/6 |
| 5,685,665 | A * | 11/1997 | Lembo | 404/6 |
| 5,860,762 | A * | 1/1999 | Nelson | 404/6 |
| 5,882,140 | A * | 3/1999 | Yodock et al. | 404/6 |
| 6,389,742 | B1 * | 5/2002 | Wuster | 47/33 |
| 6,767,158 | B1 * | 7/2004 | Consolazio et al. | 404/6 |
| 6,837,647 | B2 * | 1/2005 | Tagg | 404/6 |
| 6,944,998 | B1 * | 9/2005 | King | 52/314 |

FOREIGN PATENT DOCUMENTS

| | | | |
|---|---|---|---|
| FR | 2 719 063 | A | 10/1995 |
| NL | 9 301 608 | A | 4/1995 |

* cited by examiner

CRASH BARRIERS FOR ROADS

RELATED APPLICATIONS

The present application is based on International Application No. PCT/IL03/00202 filed Mar. 12, 2003, and claims priority from, Israeli Application Number 148,689, filed Mar. 14, 2002, the disclosure of which is hereby incorporated by reference herein in its entirety.

FIELD OF THE INVENTION

The present invention relates to crash barriers for roads and highways, and more particularly, to crash barrier assemblies made of prismatic elements and to a method for assembling such barriers.

BACKGROUND OF THE INVENTION

Solid crash barriers made of concrete are built along the roads, either by in situ casting or by interconnecting the side surfaces of individual prefabricated elements to each other, e.g., by means of male/female connectors, steel hooks and loops, etc., as per se known.

There are several disadvantages to the above-mentioned prior art crash barriers, the first being the rigidity of the barriers as compared with barriers made, e.g., of steel rails or cables. A second disadvantage is that it is very difficult and time-consuming to achieve a smooth, contiguous upper edge at the desired level of the interconnected individual prefabricated elements forming these barriers.

SUMMARY OF THE INVENTION

It is therefore a broad object of the present invention to provide crash barrier elements for roads and highways and a method for assembling same which ameliorates the disadvantages of prior art barriers of the same type.

It is a further object of the present invention to provide a crash barrier assembly erected from individual solid building elements which provide a smooth, contiguous surface in both the vertical and horizontal surfaces and edges.

It is a still further object of the present invention to provide a crash barrier assembly made of interconnected individual solid building elements including energy-absorbing material, providing a barrier having controllable elasticity upon impact by a vehicle.

In accordance with the invention, there is therefore provided a crash barrier assembly, comprising a plurality of prismatic, solid structural elements, at least one of the elements having a shoulder forming two vertical surfaces and a horizontal surface on at least one of its sides, and another element having substantially matching surfaces on at least one of its sides so as to facilitate juxtaposing of the elements, and coupling means for resiliently interconnecting the elements to each other in a manner facilitating relative controlled movement along the horizontal surface of the one element with respect to the other about the coupling means.

The invention further provides a method for erecting a crash barrier, comprising the steps of providing a plurality of elements according to claim 3; juxtaposing at least two of said elements, and interconnecting said elements by driving said rod through the horizontal surfaces of said elements.

BRIEF DESCRIPTION OF THE DRAWINGS

The invention will now be described in connection with certain preferred embodiments with reference to the following illustrative figures so that it may be more fully understood.

With specific reference now to the figures in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the drawings:

FIGS. 1A and 1B are isometric views of two embodiments of juxtaposed crash barriers according to the present invention;

FIG. 2 is a schematic, longitudinal cross-sectional view illustrating the interconnection between the barrier elements of FIGS. 1A and 1B;

FIG. 3 shows a preferred embodiment of the barrier of FIG. 2;

FIG. 4 illustrates a modification of the embodiment of FIG. 3;

FIG. 5 shows a further embodiment of the invention;

FIG. 6 is an enlarged view of a detail of FIG. 5;

FIG. 7 is a schematic representation of still a further embodiment of the interconnection between barrier elements;

FIG. 8 is a schematic cross-sectional view of yet a further embodiment of the interconnection between barrier elements;

FIG. 9 is a cross-sectional view of a further embodiment of the interconnection between barrier elements;

FIG. 10 is an asymmetric view of an edge of a barrier element fitted with an energy-absorbing body, and FIGS. 11A and 11B are asymmetric views of an energy-absorbing body and edges of a barrier element fitted therewith.

DETAILED DESCRIPTION

Figure 1A:
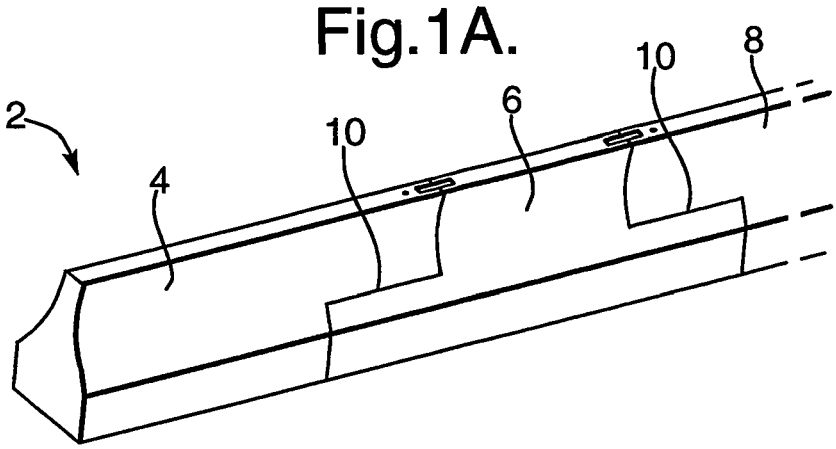
Figure 1B:
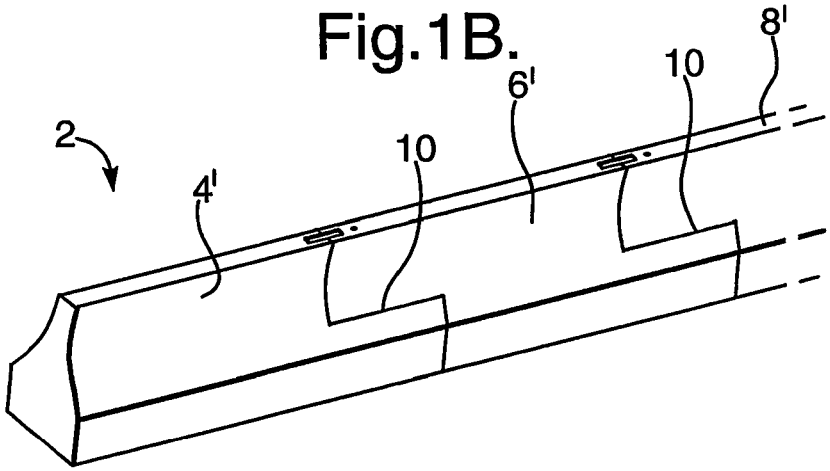

FIGS. 1A and 1B illustrate isometric views of two embodiments of a crash barrier 2 for roads and highways. Barrier 2 is assembled from juxtaposed, prismatic structural elements, e.g., the general trapezoidal elements 4, 6, 8 or 4', 6', 8'. The elements may be configured in many ways, e.g., having a general trapezoidal shape, as shown, or may advantageously be symmetrical with respect to their top, bottom and side surfaces, so as to enable their positioning in reverse orientations, e.g., elements 8 and 8'.

As further seen in the Figures, the characterizing feature of the elements are the shoulders 10, having two vertical surfaces and a horizontal surface, which serve as inter-engagement surfaces with an adjacent element or elements.

Figure 2:
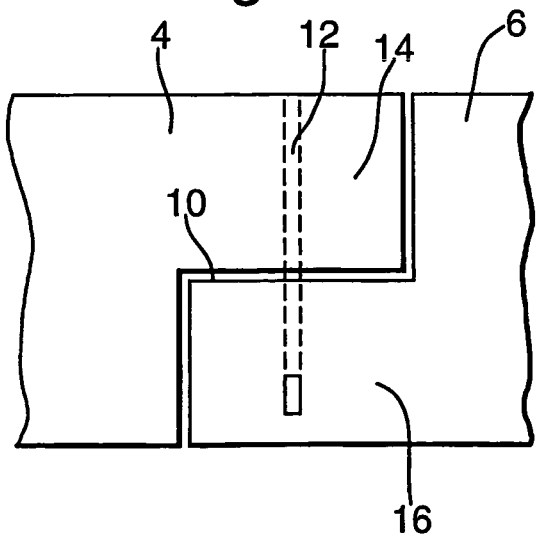

Referring to FIG. 2, shown are portions of two juxtaposed elements 4 and 6, interconnected by coupling means consisting of a pin or rod 12 traversing the upper portion 14 of element 4 and entering into a lower portion 16 of element 6. The connecting surfaces between elements 4 and 6 traverse the horizontal planes of the elements.

Figure 3:
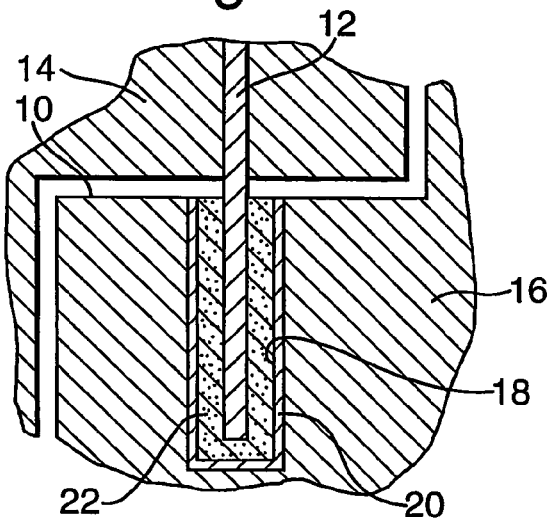
Figure 4:
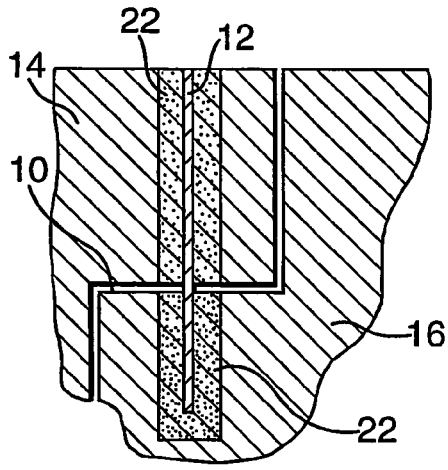

FIG. 3 schematically illustrates a preferred embodiment of the invention, in which the upper portion of the element 4 and the lower portion 16 of the element 6 of the two juxtaposed elements 4 and 6 are interconnected by means of a rod 12 extending into a bore 18 advantageously, but not necessarily, lined by a cup 20, at least partly filled with energy-absorbing material 22, e.g., cement-based material, neoprene, rubber, Teflon®, a metallic, sponge-like body, one or more metallic springs, or like elastic materials. As seen in FIG. 4, in addition to, or instead of the energy-absorbing material 22 in the lower portion of an element, the energy-absorbing material with or without a cup 20 may be located around rod 12, traversing the upper portion 14 of the element 4. Any or both of the elements 4 and 6 may be formed with a bore for accommodating the energy-absorbing material 22, with or without a cup 20, introduced therein.

Hence, as will be understood, when a vehicle crashes into a barrier 2 constructed according to the present invention, the impacted element will absorb and soften the blow at least to some extent, before bringing the crashing vehicle to a stop. Obviously, the strength of the elements and the rods, and the resiliency of the coupling means between the elements can be predetermined and adapted to different road hazards, the types of vehicles travelling along the road, and their speed. Any impact will thus cause a controlled movement of one element about the coupling means, along the horizontal surface of the shoulder 10 with respect to another, adjacent element.

Figure 5:
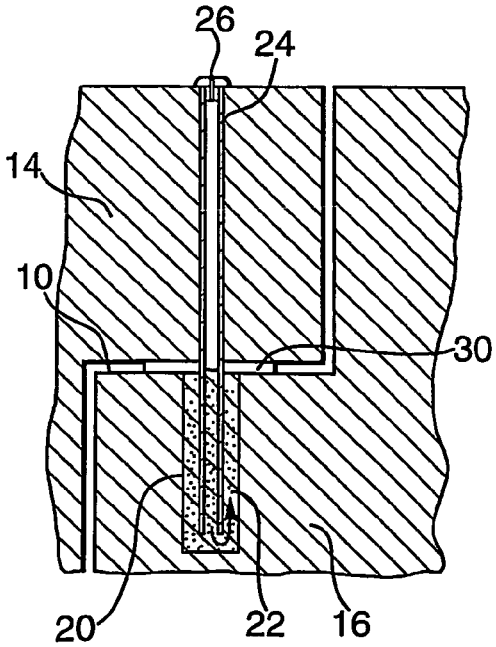
Figure 6:
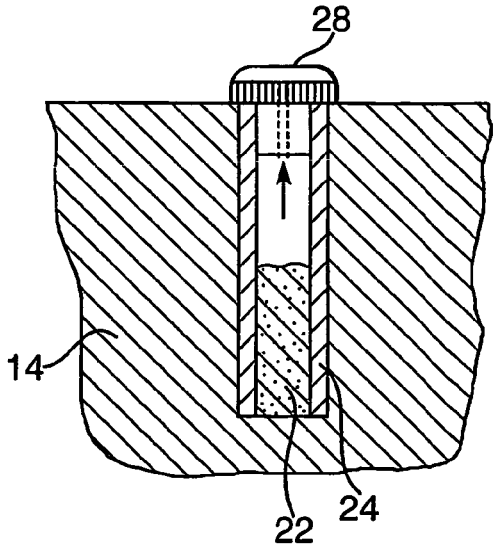

A further embodiment of the invention is shown in FIG. 5. In this embodiment, the energy-absorbing material 22 is a hydraulic fluid such as oil. Accordingly, rod 12 is constituted by a tube 24 having at its top a removable plug 26, facilitating the introduction of hydraulic fluid into the tube after the barrier 2 is assembled. Advantageously, plug 26 may be a pressure-sensitive plug 28 (FIG. 6). This type of elastic coupling means also necessitates a seal 30 for sealing off the cup 20. The inner diameter of the tubular rod 24, the type of hydraulic fluid and pressure-sensitive plug 28 will determine, inter alia, the energy-absorbing capability of the crash barrier assembly. Plug 28 can also be positioned at the bottom of the tube 24.

Figure 7:
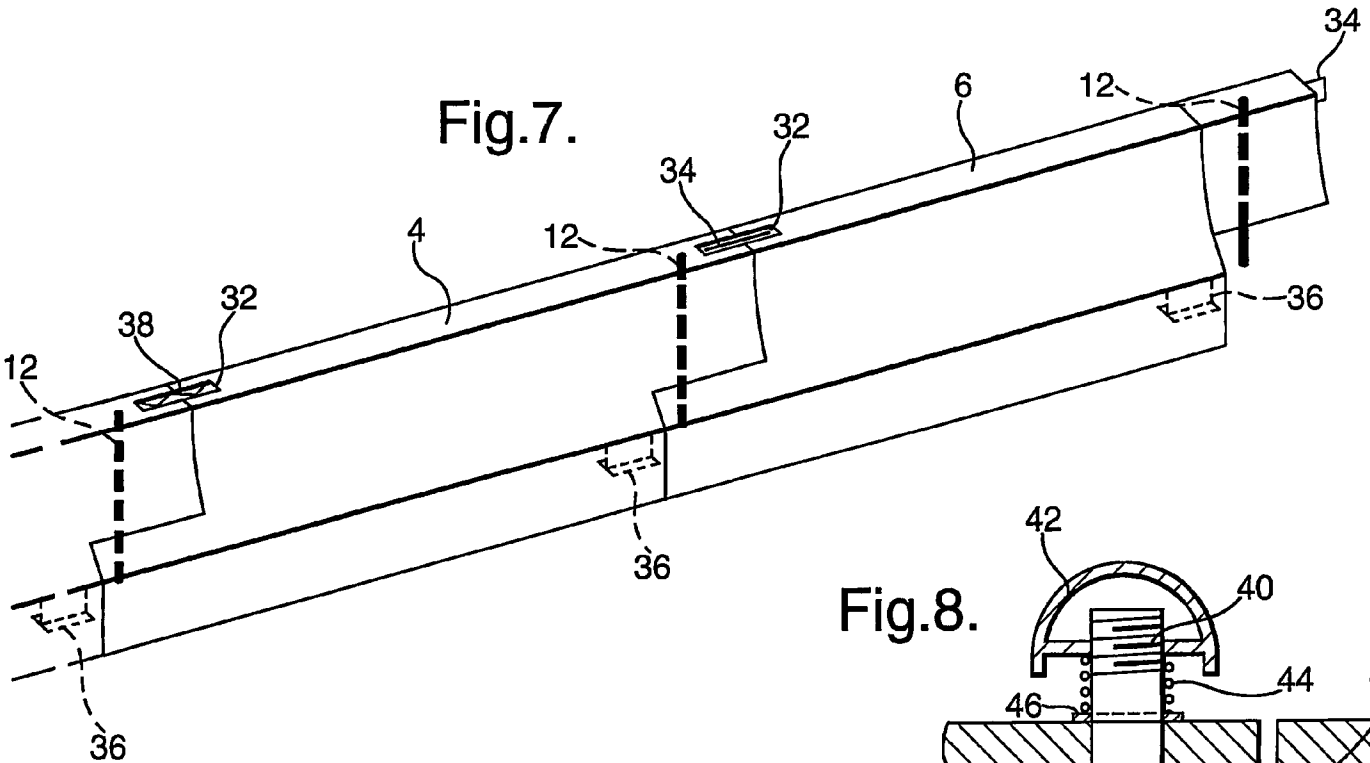

In FIG. 7 there is illustrated a further embodiment for resiliently interconnecting two adjacent elements 4 and 6. The elements are provided with narrow slots 32 at the upper and/or lower edges, into which slots there are inserted resilient plate members made of metal or any other suitable energy absorbing material. The plates may be configured as simple flat members 34, as T-shaped members 36 or as a curved leaf spring 38. Any one of the flat members and the T-shaped members may be used on the upper or lower sides of the elements 4 and 6. The insertion of such resilient members at the connecting edges of two adjacent elements contributes in absorbing impact forces in order to stop a hitting vehicle while acting as a further damper for absorbing impacting energy.

Figure 8:
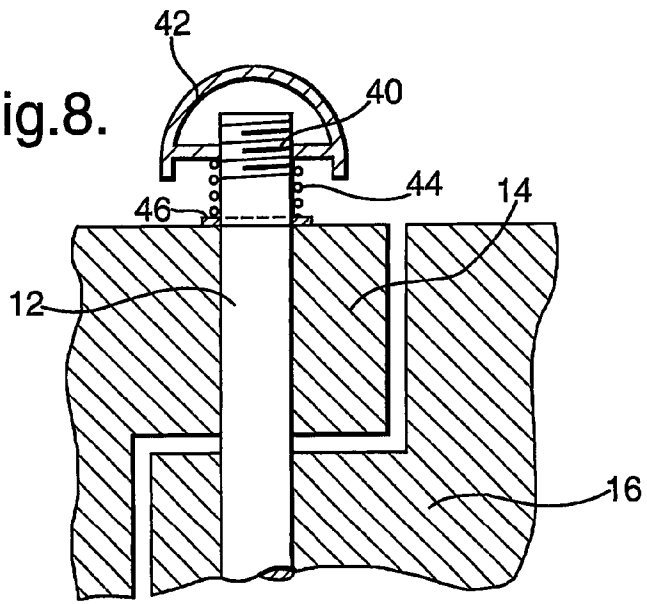

Further resiliency of the assembly can be achieved, as seen in FIG. 8, by furnishing the upper, exposed edge of the coupling rod 12 with a thread 40 onto which a suitable cap 42 can be screwed against the force of a spring 44. As seen, the spring 44 bears against the upper portion of an element 4, advantageously via a disk 46.

Figure 9:
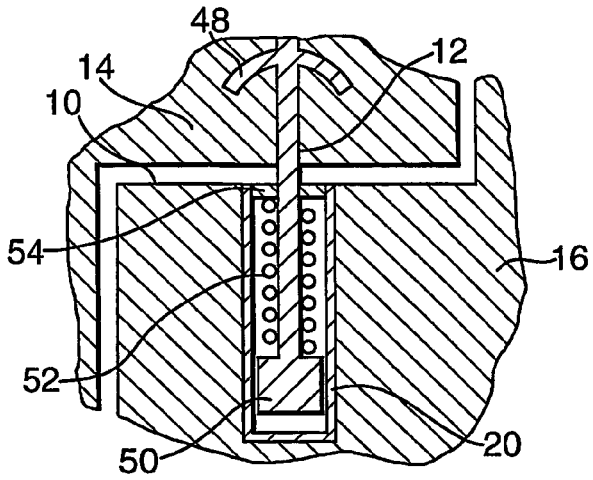

FIG. 9 illustrates a further improvement with regard to the energy-absorbing capability of the crash barrier assembly. The road 12 may optionally be made with one or a plurality of anchoring members 48 and similar to the embodiment of FIG. 8, the lower part of the road 12 may be configured as a square plate or cube 50. A compression spring 52 is disposed between the cube 50 and a disk 54, constituting an integral part of the cup 20. Hence, impact against such elements will, to some degree, be absorbed by the spring 52.

The gaps between the horizontal and vertical interconnecting surfaces of the juxtaposed elements can be filled in with suitable filling materials having various degrees of resiliency.

In order to further increase the resiliency of the assembly, energy-absorbing resilient bodies 58 (FIG. 10), may be attached by any per se known means, e.g., screws or nails 60, to one or two of the interfacing vertical surfaces of the elements 4 and 6. Such bodies 58 may be configured as square plates, triangular prisms or trapezoidal bodies.

Figure 10:
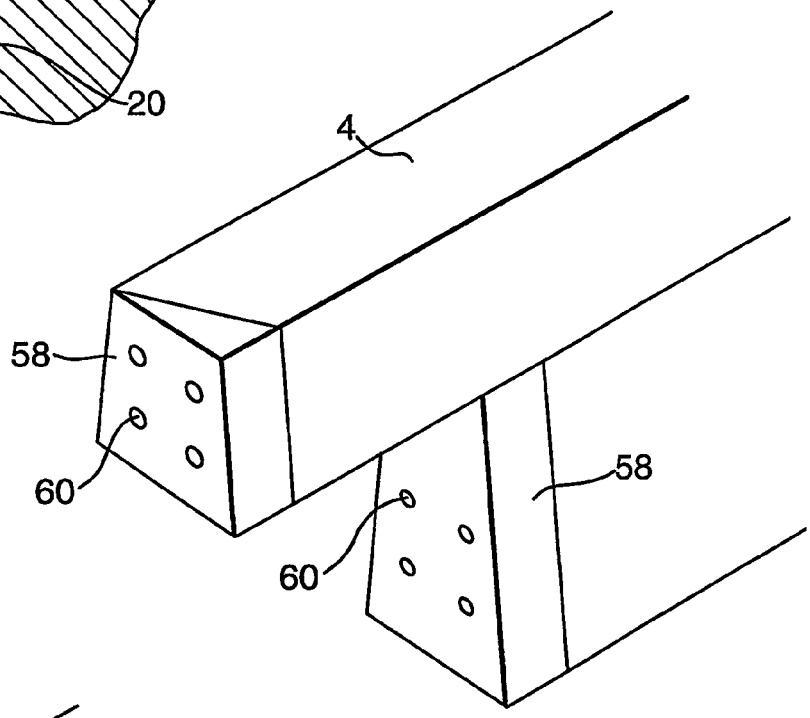
Figure 11B:
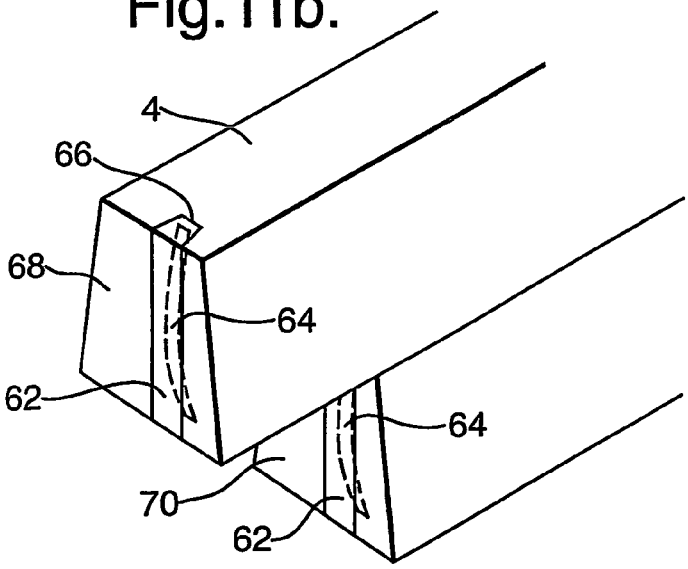
Figure 11A:
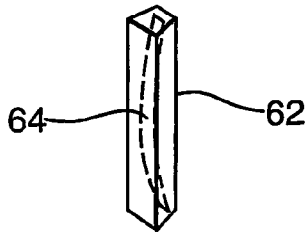

FIGS. 11A and 11B show a modification of the energy-absorbing resilient bodies 58 of FIG. 10. FIG. 11A illustrates a prismatic body 62, made of any suitable energy-absorbing material, examples of which were described hereinbefore. Advantageously, inside the body 62, there is embedded a reinforcing element in the form of, e.g., a leaf spring 64. The entire body is inserted in a suitably configured preformed groove 66 made in one or both of the lateral vertical surfaces of the elements. Upon impact, an element 4 and/or 6 is angularly displaced with respect to one or two adjacent elements. The corner or corners of the elements may just be chipped off and eventually, the remaining corner parts will bear against the prismatic body 62, also providing absorption of some of the impact energy.

While the shown embodiments illustrate a symmetrical crash barrier assembly especially suited to be erected between two roads, it should be understood that the same type of assembly can also be performed with barrier elements configured to absorb crashes from one side only, namely, non-symmetrical elements.

It will be evident to those skilled in the art that the invention is not limited to the details of the foregoing illustrated embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

The invention claimed is:

1. A crash barrier assembly, comprising:

a plurality of prismatic, solid material structural elements, at least one of said elements having a shoulder forming two vertical surfaces and a horizontal surface on at least one of its sides, and another element having substantially matching surfaces on at least one of its sides so as to facilitate juxtaposing of said elements, with a gap at least between juxtaposed vertical surfaces, a coupling structure in the form of a hole or bore and a rod at least partially located in said hole or bore with a clearance traversing said horizontal surface and interconnecting said elements to each other in a manner facilitating relative controlled movement along the horizontal surface of one element with respect to the other about said coupling structure, and energy-absorbing material, different than said solid material, located in said hole or bore in at least one of said elements and surrounding at least a portion of said rod, whereby, upon impact, the relative movement between two adjacent elements about said rod, is attenuated by energy absorbed by the energy-absorbing material.

2. The crash barrier assembly as claimed in claim 1, wherein said elements are generally trapezoidal in shape.

3. The crash barrier assembly as claimed in claim 1, wherein said energy-absorbing material comprises one of neoprene, rubber, metallic sponge, a metal spring or springs, and hydraulic fluid.

4. The crash barrier assembly as claimed in claim 1, wherein said coupling structure further comprises a cup-lined bore in said horizontal surface, into which said rod extends.

5. The crash barrier assembly as claimed in claim 1, wherein said rod is formed with integral anchoring members.

6. The crash barrier assembly as claimed in claim 1, wherein said rod is formed at its lower portion with a multi-sided body.

7. The crash barrier assembly as claimed in claim 1, wherein said energy-absorbing material is disposed in a groove formed in at least one of the vertical surfaces of said shoulder.

8. The crash barrier assembly as claimed in claim 1, further comprising energy-absorbing material affixed on one or both of the vertical surfaces of said shoulder.

9. The crash barrier assembly as claimed in claim 1, wherein said energy-absorbing material comprises polytetrafluoroethylene.

* * * * *